United States Patent [19]

McCarroll

[11] Patent Number: 4,686,840

[45] Date of Patent: Aug. 18, 1987

[54] LOCK GUARD

[76] Inventor: Clark McCarroll, 168 Hillcrest Dr., Munhall, Pa. 15121

[21] Appl. No.: 945,820

[22] Filed: Dec. 24, 1986

[51] Int. Cl.[4] ..... E05B 67/38

[52] U.S. Cl. ..... 70/54; 70/454; 70/455

[58] Field of Search ..... 70/51, 52, 54–56, 70/395–397, 454, 455

[56] References Cited

U.S. PATENT DOCUMENTS

| | | | |
|---|---|---|---|
| 3,559,429 | 2/1971 | Hermann | 70/56 X |
| 3,714,804 | 2/1973 | French | 70/455 X |
| 3,751,948 | 8/1973 | Klein | 70/55 |
| 3,765,199 | 10/1973 | Wiczer | 70/455 X |
| 3,857,264 | 12/1974 | Fowler | 70/395 X |
| 4,218,902 | 8/1980 | Druschel | 70/55 |
| 4,576,022 | 3/1986 | Gamble | 70/55 |

FOREIGN PATENT DOCUMENTS

| | | | |
|---|---|---|---|
| 267905 | 4/1950 | Switzerland | 70/396 |

*Primary Examiner*—Robert L. Wolfe
*Assistant Examiner*—Suzanne L. Dino
*Attorney, Agent, or Firm*—William J. Ruano

[57] ABSTRACT

A lock guard to prevent picking of locks by thieves, which guard is particularly useful for mailboxes subject to weather and vending machines which store money. The guard is essentially a rectangular box having a side opening for insertion of the padlock and a pair of slots at right angles to each other, one slot below the side opening and the other at right angles on the front portion of the box. By clipping a key to a lever and inserting it in the first mentioned slot and then rotating it in the last mentioned slot the padlock may be unlocked.

2 Claims, 9 Drawing Figures

LOCK GUARD

This invention relates to a lock guard, particularly for padlocks.

BACKGROUND OF THE INVENTION

Padlocks are widely used, such as for mailboxes and other devices exposed to the weather. An outstanding disadvantage in their use in mailboxes is theft, since thieves soon acquire the ability to pick the lock and remove valuable contents of the mailbox.

BRIEF SUMMARY OF THE INVENTION

An object of the invention is to provide a novel lock guard which will overcome the above named disadvantages.

A more specific object of the invention is to provide a guard which will cover the body and tumbler of the lock and require the key to be inserted and turned while the lock is so covered.

DETAILED DESCRIPTION OF THE DRAWING

Referring more particularly to the drawings.

Figure 6:
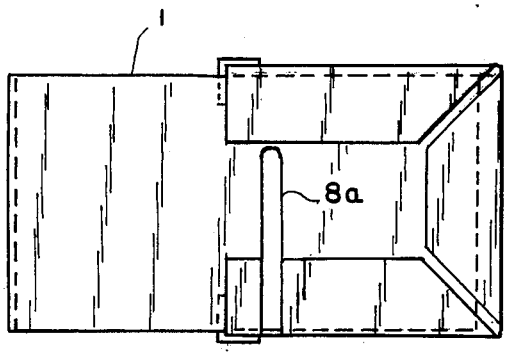
Figure 7:
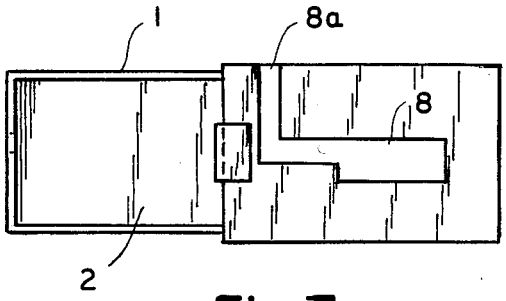
Figure 8:
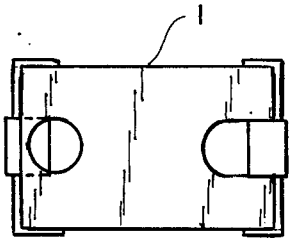
Figure 9:
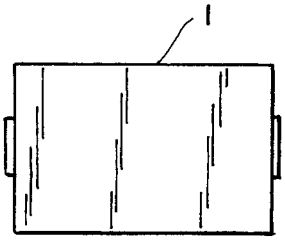

FIG. 6 is a top view; FIG. 7 is a side view; FIG. 8 is a leftend view; and FIG. 9 is a rightend view, respectively, of a lock guard embodying the present invention.

DESCRIPTION OF THE PREFERRED EMBODIMENT

Figure 1:
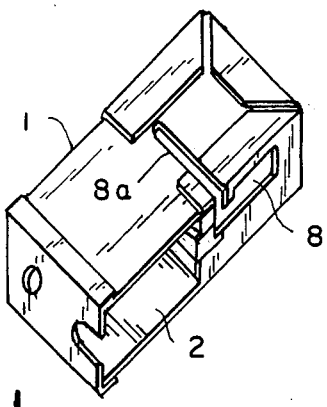
FIG. 1 is an exploded view of a lock guard and key supporting lever embodying the present invention.
Figure 2:
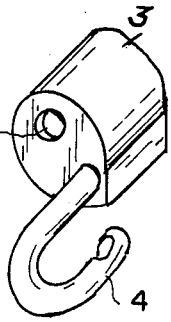
FIG. 2 is a perspective view of an ordinary padlock for insertion therein.

Referring to FIGS. 1 and 2, numeral 1 denotes a lock guard of metal or strong plastic material having an opening 2 into which a padlock 3 of conventional design may be inserted and thereafter the link or stem 4 of the lock is turned and pushed into the lock opening 5 for locking.

Figure 3:
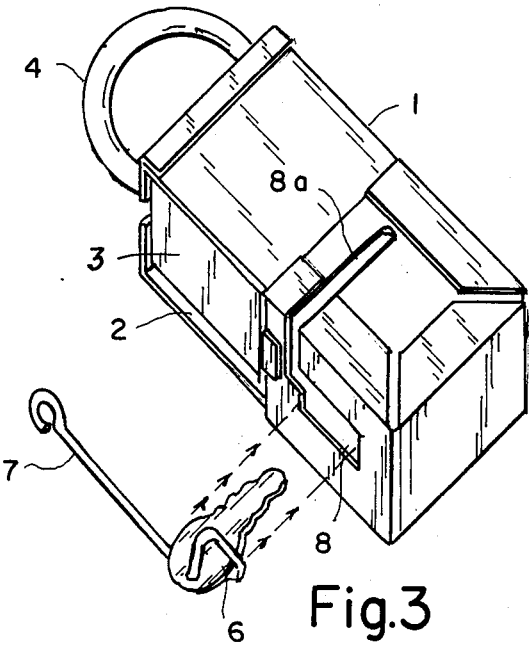
FIG. 3 is an exploded view of the lock guard of FIG. 1 and of a lever for supporting the key for insertion through a slot in the direction of the arrow.
Figure 5:
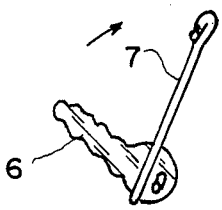
FIG. 5 is the final position showing the key turned another 90° so as to unlock the lock.
Figure 4:
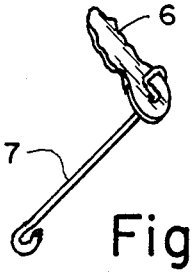
FIG. 4 is the next position of the key after turning 90° and pushing it into the lock barrel.

After the lock is inside of the guard 1, and referring to FIG. 3, a key 6 is detachably mounted on a lever clip 7 so shaped to form a clip to tightly grasp the key and to provide leverage thereto so that the key can be inserted in the direction of the arrows through slot 8. It is then turned 90° in the plane of the key, then pushed into the lock barrel, as shown in FIG. 4, and finally lever clip 7 is turned another 90° through slot 8*a* in the direction of the arrow shown in FIG. 5 to open the lock.

FIG. 6 is a top view, FIG. 7 is a side view, and FIGS. 8 and 9 left end and right end views, respectively, of the guard 1.

It will be noted that while the lock is in guard 1, its barrel is covered by the end of the guard, as shown in FIG. 9, therefore not available for picking of the lock by a thief. Also said closed end of the guard protects the exposed barrel against ice, snow and rain that often times causes rusting and inability to unlock the lock even with a key.

The clip has been so designed to enable the key to be inserted and removed and also have stability to rotate the key.

Slot 8 has a larger width in the area for introducing the key and slid to an area of smaller width to precisely position the key for insertion in the barrel of the lock.

Although the invention has been described as particularly useful for padlocks subject to weather, it is highly useful also for vending machines not exposed to weather since they always contain money.

Thus it will be seen that I have provided a guard for a padlock which requires insertion of a key through a groove of the guard in a manner as to require leverage turning of the key.

I claim:

1. A lock guard for a padlock comprising a rectangular container having an opening in about one half portion of its side for insertion of the body of the padlock and having on the same side in the other half portion thereof, a pair of slots at right angles to each other and below the position of the padlock, to enable a leverage clip to insert the key into one of said slots, turn it 90° in the plane of the key, then insert the key into the barrel of the padlock and thereafter turn said clip through the other of said slots to unlock the lock.

2. A lock guard as recited in claim 1 wherein said one of said slots has a portion of larger width in the area of insertion of the leverage clip than in the area closer to the lock whereby the key may be accurately positioned for insertion in the said barrel.

* * * * *